US012607435B2

(12) United States Patent
Yedaya

(10) Patent No.: US 12,607,435 B2
(45) Date of Patent: Apr. 21, 2026

(54) METHOD FOR DETECTING A SHOT HIT WITH AN INFLATABLE SHOOTING TARGET AND FOR PROVIDING A REAL-TIME INDICATION OF THE HIT

(71) Applicant: Libi Yedaya, Yakir (IL)

(72) Inventor: Libi Yedaya, Yakir (IL)

( * ) Notice: Subject to any disclaimer, the term of this patent is extended or adjusted under 35 U.S.C. 154(b) by 316 days.

(21) Appl. No.: 18/223,032

(22) Filed: Jul. 18, 2023

(65) Prior Publication Data

US 2023/0358513 A1 Nov. 9, 2023

Related U.S. Application Data

(63) Continuation-in-part of application No. 17/373,835, filed on Jul. 13, 2021, now abandoned.

(60) Provisional application No. 63/051,905, filed on Jul. 15, 2020.

(51) Int. Cl.

| | |
|---|---|
| ***F41J 5/04*** | (2006.01) |
| ***F41J 7/04*** | (2006.01) |
| ***F41J 9/02*** | (2006.01) |

(52) U.S. Cl.

CPC . *F41J 5/04* (2013.01); *F41J 7/04* (2013.01); *F41J 9/02* (2013.01)

(58) Field of Classification Search

None

See application file for complete search history.

(56) References Cited

U.S. PATENT DOCUMENTS

| | | | | |
|---|---|---|---|---|
| 4,505,481 | A | 3/1985 | Knight | |
| 5,238,406 | A | 8/1993 | Littell | |
| 11,950,588 | B2 * | 4/2024 | Lazar | F41J 9/02 |

FOREIGN PATENT DOCUMENTS

| | | | |
|---|---|---|---|
| CN | 108955499 | | 12/2018 |
| GB | 2138113 | | 4/1983 |
| JP | 2004125224 | A * | 4/2004 |
| JP | 2016214442 | A * | 12/2016 |

* cited by examiner

*Primary Examiner* — Sunit Pandya

(57) ABSTRACT

A method for detecting a shot hit on an inflatable shooting target and for providing a real-time indication of the hit. The method includes the step of providing a shooting target system with one or more inflatable shooting targets, each of them is assembled on a blower, a power source that is connected to each blower through a controller that controls the activation of each blower, and a current meter between the controller and the power source. The method includes the second step of measuring the current that flow to a certain blower, detecting changes in the current level that occurs upon a hit in a certain inflatable shooting target that is assembled on that certain blower, and making and indication of the hit by turning off the certain blower or by sending a notification to a mobile device of the user or the operator.

1 Claim, 1 Drawing Sheet

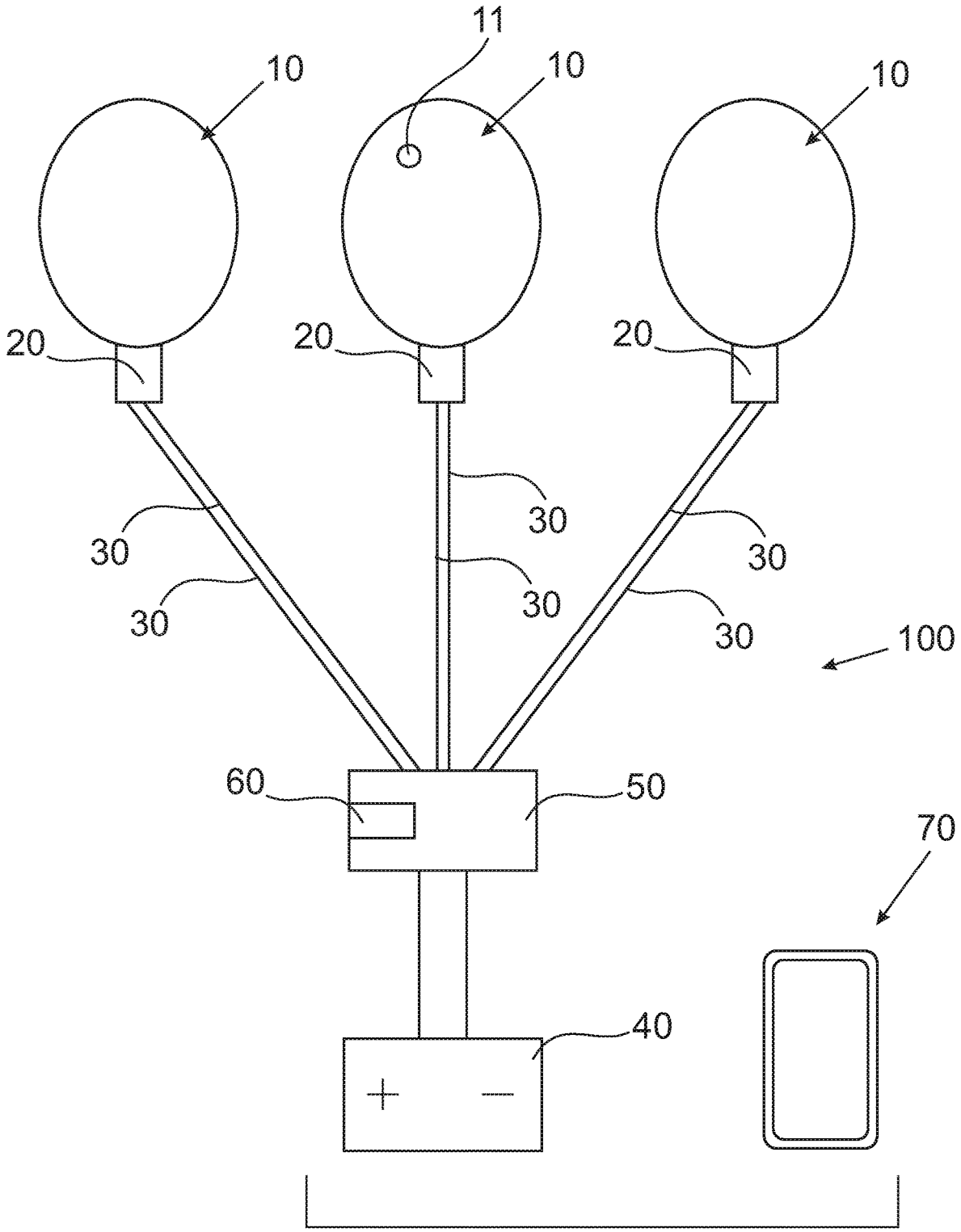
11
10
10
10
20
20
20
30
30
30
30
30
30
100
60
50
70
40
+
−

METHOD FOR DETECTING A SHOT HIT WITH AN INFLATABLE SHOOTING TARGET AND FOR PROVIDING A REAL-TIME INDICATION OF THE HIT

RELATED APPLICATIONS

This application is a continuation in part of a U.S. patent application Ser. No. 17/373,835 filed on Jul. 13, 2021, that claims a priority from a U.S. Provisional Application No. 63/051,905, filed on Jul. 15, 2020.

TECHNICAL FIELD

The present invention refers to a method for detecting a shot hit with an inflatable shooting target and for providing a real-time indication of the hit. Prior art JP 2004125224 (Hiramatsu) discloses inflatable shooting targets, and JP 2016214442 (Inapi) discloses a futon dryer that is designed to stream hot air between the comforter and the matrass of the futon with the intention to dry the futon matrass. It is clearly understood that the air should be leak outside through small gaps all around the four sides of the matrass, and in such case we may say that the use of the futon dryer is efficient due to the fact that the hot air is streaming under all the entire area of the matrass. But, when the dryer works too high a relatively big gap can be created in one side of the matrass and in such case most of the hot air will stream from the dryer through a 'corridor' and outside through this gap, and the other parts of the matrass will not be dried. For detecting the occurrence of such big gap the inventor of JP 2016214442 (Inapi) uses a current meter for measuring the current and detecting current changes that leads to a conclusion that such a big gap was created. None of the prior art discloses the use of a current meter for measuring a current to a blower of an inflatable shooting target, using the occurrence of detected current changes as indication of a shot hit on the inflatable shooting target and for providing in real time indication to the user.

BACKGROUND OF THE INVENTION

Shooting targets are disadvantaged in that they provide a poor indication of the result of shooting performed thereon, being a small hole only, and there is a long-felt need to provide a solution to this problem and others of the prior art.

SUMMARY OF THE INVENTION

The present invention discloses a method for detecting a shot hit with an inflatable shooting target and for providing a real-time indication of the hit on the inflatable shooting target. The method comprising: Provide a shooting target system that includes one or more inflatable shooting targets, where each inflatable shooting target is assembled on a blower. A power source that is electrically connected through a controller to each blower, the controller is designed to control the activations of each blower, and a current meter that is connected between the controller and the power source.

Measure by the current meter the current that flow to a certain blower.

Detect, by the current meter, changes in the current level that flows to the certain bower, upon a hit in a certain inflatable shooting target that is assembled on the certain blower.

Make and indication, by the controller, upon occurrence of said hit in said certain inflatable shooting target by sending by turning off the certain blower or by sending a notification to a user or an operator of the system.

BRIEF DESCRIPTION OF THE DRAWINGS

The intention of the drawings attached to the application is not to limit the scope of the invention and its application. The drawings are intended only to illustrate the invention and they constitute only one of its many possible implementations.

FIG. 1 depicts schematically a shooting target system (100) that includes several inflatable shooting targets (10).

DETAILED DESCRIPTION OF THE INVENTION

The invention will be understood from the following detailed description of embodiments of the invention, which are meant to be descriptive and not limiting. For the sake of brevity, some well-known features are not described in detail.

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

The main object of the present invention is to provide a method for detecting a shot hit with an inflatable shooting target (10) and for providing a real-time indication of the hit on the target. The basic step of the method is to provide a shooting target system (100) that includes one or more inflatable shooting targets (10). Each inflatable shooting target (10) includes a blower (20) that is electrically connected by electrical wires (30) to a power source (40) through a controller (50). It is possible that each inflatable shooting targets will be assembled directly on its blower or that an air pipe will stream the air from the blower to the inflatable shooting target. The shooting target (10) may be made by a fabric for example.

The controller controls the activations of the blowers (by connecting the blowers electrically to the power source). The user or the operator of the system may operate the controller remotely (for example by a mobile device (70) that may be a dedicated mobile device for operating the system or even a mobile device through a smartphone application). When the user wishes to use the system he operates it and activates the relevant blowers for filling air into the relevant inflatable shooting targets. When the system includes several targets the user can inflate them at once are one by one after hitting the target. FIG. 1 depicts schematically the shooting target system (100) that includes for example three inflatable shooting targets (10).

The system (100) also includes a current meter (60) that is connected onto the electrical wires (preferably) between the controller and the power source (mainly when the system is aimed to be used by inflating each inflatable shooting target in turns and not together at same time.

When the blower is on and the inflatable shooting target is already full of air, then a load is created on the blower (air resistance inside the target), and in such a situation the current reaching the blower is stable one a certain level. When the target is hit, a hole (11) is created from which air leaks out, something that reduces the load on the blower and then the current changes. The inflating of air by the blower is larger than the release of air through the hole (11), thus the target is yet inflated. The change in current measured by the current meter is an indication of hitting the target. In such a case, the system provides an indication of the hit, for example, by stopping the blower operation, and then the user sees from a distance that the target has been emptied of air or the system via the controller sends an indication signal to the operator's mobile phone. The decrease of electric current is an indication of successful shooting. The controller receives the information of the (decrease) change of the electric current and provides the indication of the hitting. In case of a second hit of the same target additional current change is occurred and a second indication can be sent or indicated.

What is claimed is:

1. A method for detecting a shot hit on an inflatable shooting target and for providing a real-time indication of the shot hit on the inflatable shooting target, the method comprising:

(a) providing a shooting target system, wherein the shooting target system comprises:

one or more inflatable shooting targets wherein each inflatable shooting target is assembled on a blower;

a power source that is electrically connected through a controller to each blowers, wherein the controller is designed to control the activation of each blower; and a current meter that is connected between the controller and the power source;

(b) measuring, by the current meter, the current that flow to a certain blower;

(c) detecting, by the current meter, change in the current level that flows to the certain blower, upon a shot hit in a certain inflatable shooting target that is assembled on said certain blower; and (d) making and indicating, by the controller, upon occurrence of said shot hit in said certain inflatable shooting target by turning off the certain blower or by sending a notification to a mobile device of a user or an operator of the system.

* * * * *